United States Patent [19]

Thomas

[11] 4,146,460

[45] Mar. 27, 1979

[54] OIL SHALE RETORT APPARATUS AND PROCESS

[76] Inventor: Delbert D. Thomas, 1522 Cameo Dr., Redlands, Calif. 92373

[21] Appl. No.: 831,813

[22] Filed: Sep. 9, 1977

[51] Int. Cl.[2] ..... C10B 1/08; C10B 49/04; C10G 1/02

[52] U.S. Cl. ..... 208/11 R; 202/128; 208/8

[58] Field of Search ..... 208/8, 11 R; 202/128

[56] References Cited

U.S. PATENT DOCUMENTS

| | | | |
|---|---|---|---|
| 1,423,527 | 7/1922 | Johns | 208/11 R |
| 1,916,900 | 7/1933 | Vandegrift et al. | 208/11 R |
| 2,434,815 | 1/1948 | Shaw | 208/11 R |
| 2,560,767 | 7/1951 | Huff | 208/11 R |
| 3,148,128 | 9/1964 | Fagnant | 202/128 |

*Primary Examiner*—Herbert Levine

*Attorney, Agent, or Firm*—Poms, Smith, Lande, Glenny & Rose

[57] ABSTRACT

A gravity feed inclined retort apparatus provides for a distillation process in which oil is removed from shale ore in the inclined portion of the retort, and the gaseous oil is removed to a vapor condenser/separator in which the vapor is condensed into the product oil. The retorted shale is fed onto a continuous chain stoker, or other similar conveying device, where the coke portion of the retorted shale is burned as fuel for the retort. Hot gases from the combustion zone where air is directed through the burning coke are used to preheat the shale ore above the dew point of the oil, through a heat exchange plate; and the hot gases then flow through the shale ore in the retort chamber, picking up the oil vapors from the heated shale, and carrying this oil-filled gas into a vapor condenser/separator. Some of the oil vapors are also condensed onto cooled side walls extending along the retort chamber and this condensed oil flows into oil collection gutters. The retort chamber is slightly enlarged along its length in the downward direction of shale movement to preclude clinkering and blockage of the continuous operation. The retort chamber is oriented at approximately 45° from the horizontal for gravity feed; and the heat exchange plate is raised at its center and pitched at an angle of about 15° relative to a line extending across its width for free shale movement down the expanding retort chamber.

17 Claims, 6 Drawing Figures

OIL SHALE RETORT APPARATUS AND PROCESS

FIELD OF THE INVENTION

This invention relates to the removal or recovery of oil from shale ore.

BACKGROUND OF THE INVENTION and SUMMARY OF THE INVENTION

Oil shortages have sent oil prices skyrocketing. Although this paints a dreary picture for many Americans, it means that production of oil from shale is becoming more and more economically feasible. However, it is not practical at present to use state-of-the-art retort apparatus on a truly economically feasible basis. While it is known that large amounts of rich oil shale are available to be mined right here in the United States, none of the prior art apparatus can continuously retort large amounts of the rich shale. One inventor, W. S. Bergen, realizing this deficiency in his own invention (#3,574,087), suggested mixing rich shale and lean shale to get an optimum medium oil content shale for his process. Of course such a requirement for carefully mixing input shale precludes full automatic operation and thus severely limits economic feasibility.

When rich shale is used, the vapors in the retort passage become saturated with oil. In many of the prior art units, these vapors rise up to the cooler shale ore, condense on this shale and cause the sticking together of shale, resulting in bridging and clinkering, finally clogging the retort.

The present invention overcomes this problem with these improvements:

First, all the shale in the retort passage is kept above the dew point, so the oil cannot condense on the shale;

Second, the retort passage is entirely gravity feed, with no moving parts to wear out or clog;

Third, the retort passage increases in cross sectional size as the shale is fed downward, thus precluding blockage by frictional engagement with the walls of a constant width or narrowing retort;

Fourth, there is a downward flow of air through the retort passage that keeps most vapor flowing from cooler shale to hotter shale, thus providing an additional feature to avoid oil condensation on the cooler shale;

Last, there are water cooled oil condensing gutters on the sides of the retort passage, separated from the shale, which remove product oil from the vapor while the vapor is still in the retort passage.

There are other reasons for clogging that makes prior art units not practical for the high through-puts necessary for economic feasibility. For example, one type of unit which has been proposed employs gas distributors within the retort where recycled shale gas is burned. These units, which are reported to represent one of the most feasible types which have been designed up to the present invention, are plugged up when clinkering and bridging occur in the area of the gas distributors. Also, the direct exposure of the shale to open flame reduces the yield from the apparatus. Another proposed retort used an inverted cone shaped retort with the oil shale being pushed in from the bottom and coke removed from the top. This unit operated satisfactorily in small sized units, but when built in larger sizes for more economically feasible production of oil from shale, it was found to have hot spots along the sides of the chamber.

Another major advantage of the present apparatus over prior art units is the method used for heating the shale up to retorting temperatures. Many of the prior art units do not even take advantage of the possibility of burning the retorted shale as fuel for the retort, and none take full advantage of the resultant heat. For example, in U.S. Pat. No. 2,434,815 to R. J. Shaw the shale is burned to make steam, and through a complex process heats the shale in the retort passage. On the other hand, in the present apparatus the gasses from the burning coke directly heat the heat exchange plate, which keeps the shale above the dew point, and also flow through the retort passage, picking up the oil laden vapor and carrying it out to a vapor condenser/separator.

Not only is the presently contemplated apparatus the most economically feasible, but also it is the most ecologically acceptable. A minimum amount of stack emission is produced and is easily controlled by electrostatic precipitators, scrubbers or any other state-of-the-art method of air pollution control. Water and ground Pollution is virtually non-existent, as this process uses no water other than the small amount of water used in equipment such as cooling towers and the generation of on-site steam which are not directly related to the actual retorting.

The present continuous feed inclined retort system combines the capability of handling very rich shale in a large daily capacity with the capability of operating without external energy sources, even on fairly lean shale, in an apparatus simpler in design and yet more economically feasible and ecologically acceptable than all known prior oil shale recovery units.

Other advantages, features and objects of the invention will become apparent from a consideration of the following detailed description and from the drawings.

BRIEF DESCRIPTION OF THE DRAWINGS

Referring in detail to the drawings, FIG. 1 shows a sample of shale ore 7 that is to be used in the retorting process. It is similar in appearance to other shale, but different in composition. It contains kerogen, a substance which yields oil when the shale is heated to retort temperatures.

FIG. 2 shows shale 8 that has just passed through the retort passage. Most of the kerogen has been converted to oil and removed from the shale, and the shale now contains and is covered with a carbonaceous residue which makes it suitable to be burned as fuel for the retort.

FIG. 3 shows the product oil 9 being poured from test tube 10 to indicate its viscosity. This oil is the condensed form of the oil vapor which is removed from shale ore 7 during the retort process.

FIG. 4 shows an illustrative inclined retort apparatus in accordance with the invention. The shale ore shown in FIG. 1 is fed into ore inlet 12 and carried up ore elevator 14 to feed hopper 16. If geographic location allows, ore can be fed directly into feed hopper 16. Rotary valve 18 controls the feed of shale ore into retort passage 20, which is inclined at approximately 45° to the horizontal, and the shale ore is gravity fed down to rotary valve 22 as the retorting process takes place. From intake rotary valve 18 to outlet rotary valve 22 the retort passage 20 continuously increases in cross sectional size to aid gravity feed by precluding blockage caused by frictional engagement between the shale 7 and the walls of retort passage 20. Rotary valves 18 and 22 are substantially air tight to prevent misdirection of air flow at the top and at the bottom of retort passage 20.

Figure 5:
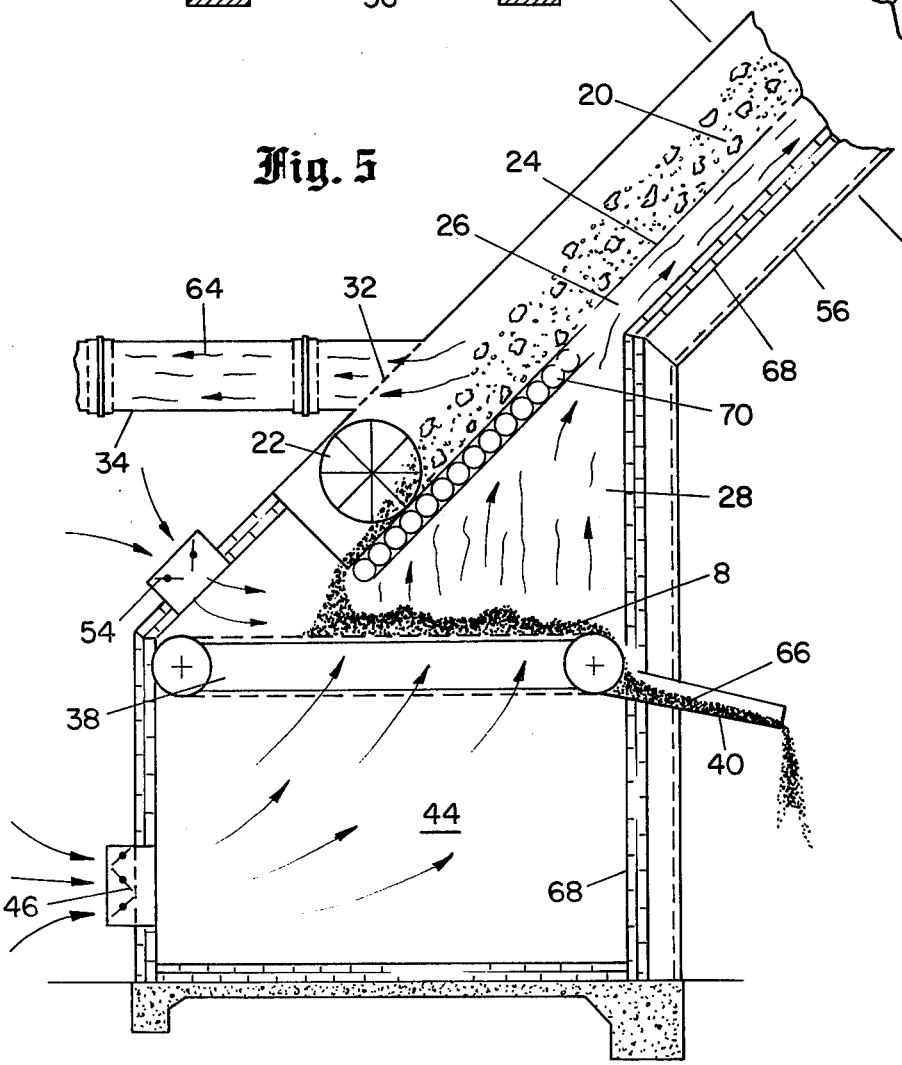
FIG. 5 is an enlarged cross-sectional view showing the upper and lower portions of the apparatus of FIG. 4.

At the bottom of the retort passage 20 and extending along its length is heat exchange plate 24, which keeps the shale ore above the oil dew point. Heat exchange plate 24 is heated by hot gasses passing through hot gas passage 26, beneath the retort passage 20. The hot gasses are fed up from the combustion chamber 28 through the hot gas passage 26 to screen 30, as shown in FIG. 5, and are then fed down through the shale in the retort passage 20 and out through screen 32 and breeching 34 to vapor condenser/separator 36.

Figure 1:
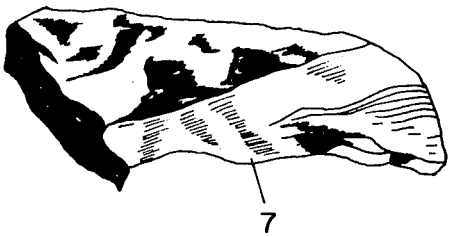
FIG. 1 shows a sample of shale oil prior to the retorting process.
Figure 2:
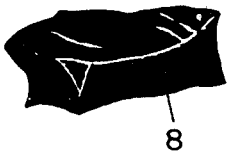
FIG. 2 shows a piece of shale or coke after having passed through the retorting passage, but not yet having been burned as fuel for the retort.
Figure 3:
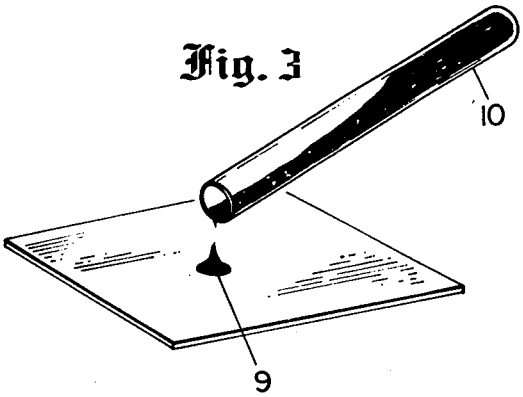
FIG. 3 shows the product oil, which has been condensed out of the vapor taken from the retorting passage.

The retorted shale is fed through rotary valve 22 onto continuous chain stoker 38 in synchronism with rotary valve 18 feeding into retort passage 20. This shale, which now has the appearance as shown in FIG. 2, is burned as fuel for the retort as it passes through combustion chamber 28 on stoker 38 and then out ash chute 40 into ash disposal vehicle 42. Air is inducted into plenum chamber 44 through primary air inlet damper 46 due to the draft created by fan 48 operating through duct 49 and the chimney effect of stack 50. The air goes from plenum chamber 44 through combustion chamber 28 and is fed into hot gas passage 26. These hot gases are used to heat the heat exchange plate 24 and to carry the oil vapor from the retort passage 20 to the vapor condenser/separator 36, where the product oil and product gases are removed. From the vapor condenser/separator 36, the effluent gases are directed up through after burner 52 and up stack 50.

There is a secondary air inlet, over-fire air damper 54, located on the side of combustion chamber 28, which assists in in the conversion of carbon monoxide (CO) to carbon dioxide ($CO_2$). Inlet dampers 46 and 54 as well as stoker 38 and rotary valves 18 and 22 are interlocked and interfaced into a control system which is capable of maintaining optimum production conditions.

Structural supports 56 are shown supporting the inclined portion of the retort apparatus.

Product piping 58 carries product oil from vapor condenser/separator 36 and oil gutter 60 to an outside storage facility (not shown). Oil gutters 60 are located along the sides of retort passage 20 and are better shown in FIG. 6.

Figure 4:
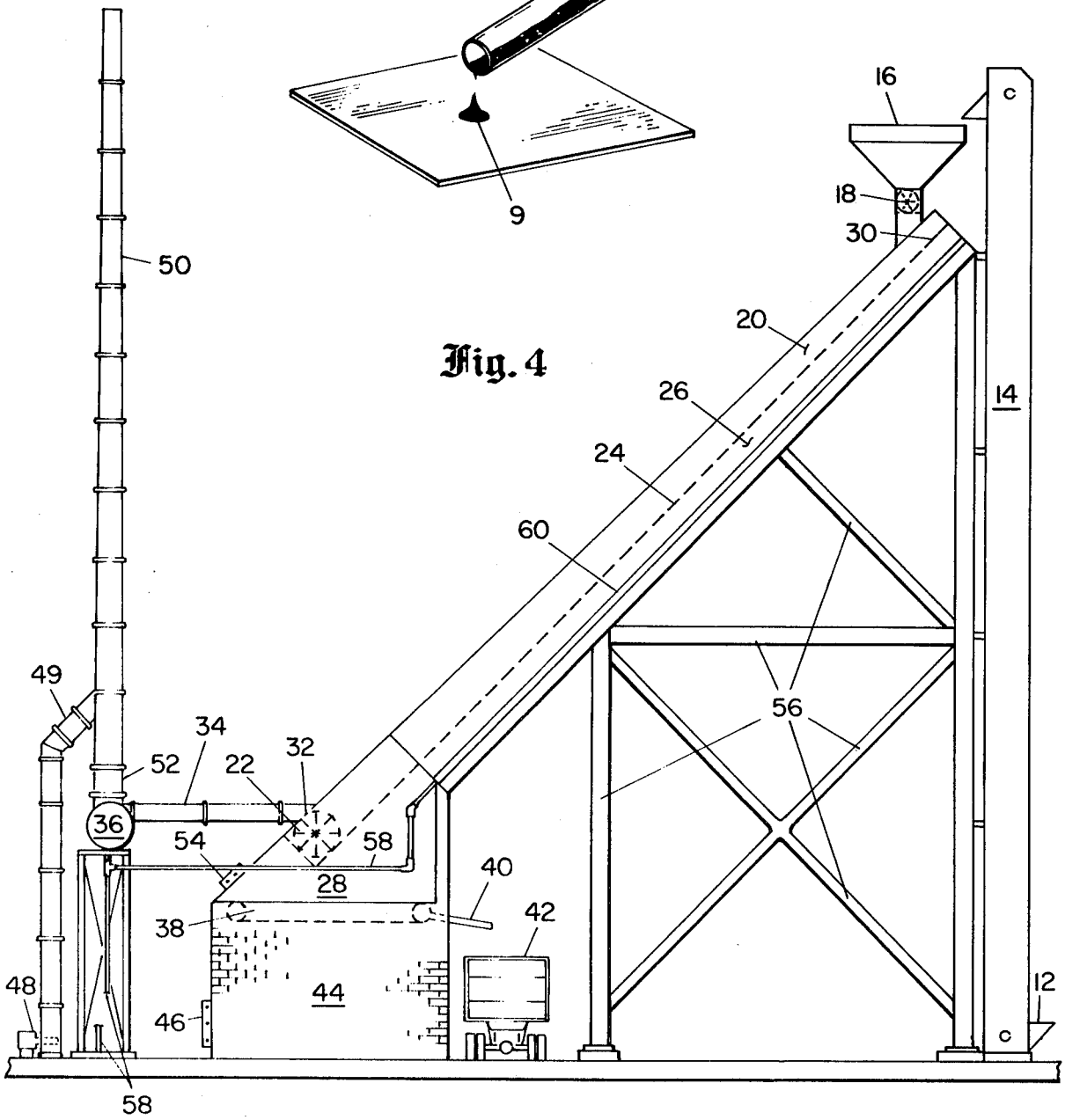
FIG. 4 is a side view of an inclined retort apparatus illustrating the preferred embodiment of the invention.
Figure 6:
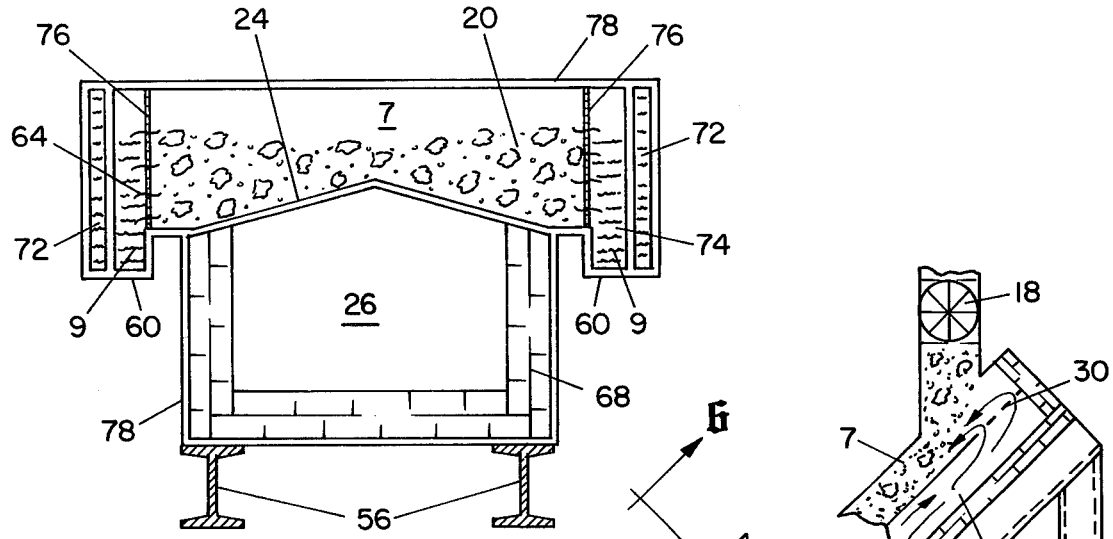
FIG. 6 is a cross-sectional view taken along lines 6—6 of FIG. 5.

FIG. 5 shows an enlarged version of FIG. 4, including more detail of certain important portions of the apparatus. Added features include:

Shale ore 7, shown in retort passage 20;

Hot gases 62 in hot gas passage 26;

Oil vapor 64 being carried by hot gases through breeching 34;

Retorted shale 8 burning as fuel for the retort apparatus in combustion chamber 28;

Shale ash 66 shown leaving the retort apparatus on ash chute 40;

Refractory brick 68 lining hot gas passage 26 to protect the outside metal casing shown in FIG. 6 as well as to minimize heat losses, and lining plenum chamber 44 and combustion chamber 28 to protect chamber surfaces as well as to promote efficient combustion due to the heat radiated from the refractory surfaces;

Water tubes 70, located in combustion chamber 28, not necessary for the operation of the retort but shown to indicate that surplus heat generated within the retort may be used to generate steam which may be used to operate pumps, fans, stokers or used as heater lines to aid oil flow during cold weather.

FIG. 6 is a detailed cross-sectional view of the inclined portion of the retort apparatus taken along lines 6—6 of FIG. 5. Oil collection gutters 60 complete with water cooled jackets 72 have been placed along each side of retort passage 20. The vapor condensing chambers 74, which lie above the oil collection gutter 60 are separated from the retort passage 20 by perforated plates 76.

As the oil vapors 64 are driven from the shale ore 7, they pass by convection through the perforated plates 76 and condense on the walls of the water cooled jackets 72, and the oil droplets flow into the bottom of the oil collection gutters 60, and run by gravity to the oil product piping 58, shown in FIG. 4, and are carried to a remote storage facility (not shown). The refractory 68 is shown lining the hot gas passage 26 to prevent damage to the metal casing 78, as well as to minimize heat loss. Heat exchange plate 24 is shown as the partition between hot gas passage 26 and shale ore 7. Heat exchange plate 24 serves as the bottom of retort passage 20 and is peaked in its center at an angle of about 15° to prevent clinkering and bridging. The peaking of the heat exchange plate 24 is felt to be an important feature in the prevention of clinkering and bridging. The distance between heat exchange plate 24 and outer metal casing 78 — the height of retort passage 20 — varies along the length of the retort passage, increasing with downward flow to preclude blockages, as previously noted.

As noted above, the apparatus as shown in FIGS. 4, 5 and 6 represents the preferred embodiments; however, departures in certain respects would still be encompassed by the present invention. For example, the apparatus could be located on a hill, in which case direct feed into hopper 16 would be practical, and much of the structural support 56 could be dispensed with. The angles of elevation of the apparatus and pitch of the heat exchange plate could be varied to accommodate different types of shale, and even coal, and when supplemental feeding structures are used. Other similar changes could be made. The simple arrangements shown in the drawings are preferred, however.

What is claimed is:

1. An inclined continuous feed retort for obtaining oil from shale ore containing kerogen comprising:

an inclined retort passage;

means for feeding oil shale into said retort passage, whereby kerogen in said oil shale is converted to gases and oil vapor, said vapor having a predetermined condensation temperature;

stoker and combustion chamber means for continuously burning the retorted shale after it emerges from the lower end of said retort passage;

a heat exchange plate forming the bottom of said retort passage;

means for diverting hot combustion gases directly from said combustion chamber means below said heat exchange plate and along its length from the lower end to the upper end thereof to maintain said shale ore at a temperature above the condensation temperature of said oil vapor, and then through said inclined retort passage to heat said shale ore to an elevated temperature and pick up the generated oil vapor; and means for separating the product oil from said gases.

2. An inclined continuous feed retort as defined in claim 1 wherein said retort passage is inclined at approximately 45° from the horizontal to induce positive gravity feed of said shale ore.

3. An inclined continuous feed retort as defined in claim 1, further comprising perforated plates located on each side of said inclined retort passage; and oil condensation passages including water cooled jackets and oil gutters located immediately outside said perforated plates, whereby oil vapor from said shale ore is drawn by convection through said perforated plates and condenses on said water jackets and is carried by gravity flow on said oil gutters to product piping below.

4. An inclined continuous feed retort, as defined in claim 1, wherein said heat exchange plate extends longitudinally of and divides the inclined portion of the retort apparatus into an upper retort section and a lower hot gas passage.

5. An inclined continuous feed retort, as defined in claim 1, wherein said retort passage increases in cross-sectional size from inlet to outlet to preclude blockage of retort passage by frictional engagement of the shale ore with the walls of the retort passage.

6. An inclined continuous feed retort as defined in claim 1 wherein said retort passage is angled at between 30° and 60° to facilitate gravity feed without blockage by excess clinkering and bridging.

7. An inclined continuous feed retort as defined in claim 1 wherein said heat exchange plate is peaked at its center.

8. An inclined continuous feed retort as defined in claim 7 wherein said heat exchange plate has two planes angled at approximately 15° with respect to a line extruding from one edge of said plate to the other.

9. An inclined continuous feed retort as defined in claim 1 further comprising:

a plenum chamber under said combustion chamber means; and damper means for supplying air to said plenum chamber.

10. An inclined continuous feed retort as defined in claim 1 wherein said stoker and combustion chamber means includes means for discharging ash as retorted material is simultaneously brought into the combustion chamber means.

11. An inclined continuous feed retort as defined in claim 1 further including means for generating steam from excess heat from said stoker and combustion chamber means.

12. An inclined continuous feed retort comprising:

an inclined longitudinally extending portion of the retort apparatus;

a longitudinally extending heat exchange plate dividing said inclined portion into an upper retort passage and a lower hot gas passage;

means for feeding solid material which generates volatile combustible material when heated through said retort;

means for burning the residual solid material after it passes through said retort at the lower end of the retort;

means for initially directing the combustion gases arising directly from the burning of said residual solid material through said lower hot gas passage; and means for subsequently directing said combustion gases into the upper end of said upper retort passage and then down the full length thereof, to further heat said solid material and to carry off said volatile combustible material.

13. A continuous feed retort for obtaining oil from shale ore comprising:

a retort passage;

means for inputting shale ore into said retort passage;

stoker and combustion chamber means for continuously burning the retorted shale;

means for outputting retorted shale into said stoker and combustion chamber means;

means for moving shale ore through said retort passage;

a heat exchange plate forming the bottom of said retort passage;

means for directing hot combustion gases directly from said combustion chamber means below said heat exchange plate to maintain the shale ore above the condensation temperature of the generated oil, and then through said inclined retort passage to heat said shale ore to an elevated temperature and pick up the generated oil vapor; and means for separating product oil from said gases.

14. An inclined continuous feed retort as defined in claim 1 wherein said retort passage is provided with outer side walls which taper outwardly from the upper end to the lower end thereof, whereby free flow of said shale is assured and clinkering and blockage is precluded.

15. A continuous retort apparatus for oil shale, as defined in claim 14 further comprising:

means for directing hot gases through said shale in the direction of movement of said shale; and means for condensing said oil vapors from said gases.

16. A method for retorting volatile components from oil shale comprising the steps of:

continuously feeding said material down an inclined retort passageway;

continuously burning the retorted material immediately upon exit from the retort passageway to provide heat for the retort process;

continuously heating said material to a temperature above the condensation temperature of the volatile components to be generated from said material by heating the floor of said retort directly by hot combustion gases from the burning of said retorted material;

subsequently directing said hot combustion gases through said material in the direction of flow of said material to heat the material and pick up said volatile components from it; and condensing at least a portion of said volatile components from said gases.

17. A method as defined in claim 16 further comprising the step of:

dispersing the material as it passes down the retort passageway to avoid clinkering and blocking of the continuous process.

* * * * *